US007936895B2

(12) United States Patent
Wang et al.

(10) Patent No.: US 7,936,895 B2
(45) Date of Patent: May 3, 2011

(54) EARPHONE STORAGE STRUCTURE

(75) Inventors: John C. Wang, Taoyuan (TW); Yi-Shen Wang, Taoyuan (TW)

(73) Assignee: HTC Corporation, Taoyuan (TW)

( * ) Notice: Subject to any disclaimer, the term of this patent is extended or adjusted under 35 U.S.C. 154(b) by 1261 days.

(21) Appl. No.: 11/523,456

(22) Filed: Sep. 19, 2006

(65) Prior Publication Data

US 2007/0160252 A1 Jul. 12, 2007

(30) Foreign Application Priority Data

Jan. 11, 2006 (TW) ..... 95101085 A

(51) Int. Cl.
*H04R 25/00* (2006.01)

(52) U.S. Cl. ..... 381/374; 381/370; 381/375; 381/379

(58) Field of Classification Search ..... 381/370, 381/374, 375, 376, 378, 379, 383
See application file for complete search history.

(56) References Cited

U.S. PATENT DOCUMENTS

| | | | | |
|---|---|---|---|---|
| 268,554 | A * | 12/1882 | Shaw | 381/379 |
| 2003/0091209 | A1 * | 5/2003 | Ito et al. | 381/379 |

FOREIGN PATENT DOCUMENTS

| | | | |
|---|---|---|---|
| CN | 2251912 | Y | 4/1997 |
| CN | 2372858 | Y | 4/2000 |
| CN | 2489519 | Y | 5/2002 |
| DE | 202004016147 | | 2/2005 |
| DE | 202005016624 | | 4/2006 |
| EP | 1211872 | | 6/2002 |
| EP | 1333649 | | 8/2003 |
| JP | 10155192 | | 6/1998 |
| JP | 2001231087 | | 8/2001 |
| JP | 2002016995 | | 1/2002 |
| JP | 2002171326 | | 6/2002 |
| TW | 503928 | | 9/2002 |
| TW | 200539663 | | 12/2005 |
| WO | WO-03103255 | | 12/2003 |

* cited by examiner

*Primary Examiner* — Suhan Ni
(74) *Attorney, Agent, or Firm* — Marshall, Gerstein & Borun LLP

(57) ABSTRACT

The present invention provides an earphone storage structure comprising a necklace, two fasteners formed in the two ends of the necklace respectively and a stopper formed in the necklace. The size of the fasteners is less than the size of the stopper and the size of the earphones. Therefore, the earphone may couple with the necklace with the fasteners fastening the earphones. Moreover, the stopper and the fasteners may together determine the extendable distance of the earphones.

6 Claims, 11 Drawing Sheets

EARPHONE STORAGE STRUCTURE

RELATED APPLICATIONS

The present application is based on, and claims priority from, Taiwan Application Serial Number 95101085, filed Jan. 11, 2006, the disclosure of which is hereby incorporated by reference herein in its entirety.

FIELD OF THE INVENTION

The present invention is about a storage structure, and more particularly, is about a structure for storing earphone.

BACKGROUND OF THE INVENTION

Listening to the music is a common leisure time activity. Earphones are used to listen to music to avoid disturbing others. However, when earphones are not being used, it is difficult to store them. Because of the long earphone wire, the wire is always wound together when the earphone is directly placed into a bag for storage.

Typically, a storage box with a winding reel is used to store earphones. The winding reel is used to wind the earphone's wire into the store box to prevent the earphone wire from getting tangled up. However, if such a storage method is used, a user must take an additional storage box to store the earphones in. It is still not very convenient for users because the earphones must initially be removed from the box before they can be used. This is especially inconvenient, when the earphones are urgently needed.

Therefore, an earphone storage structure that can avoid the foregoing problems is required.

SUMMARY OF THE INVENTION

Therefore, the main purpose of the present invention is to provide an earphone storage structure that may prevent the earphone's wire from getting tangled up.

Accordingly, the present invention provides an earphone storage structure comprising a necklace, two fasteners formed in the two ends of the necklace respectively and a stopper formed in the necklace. The size of the fasteners is less than the size of the stopper and the size of the earphones. Therefore, fasteners may couple the earphone with the necklace. Moreover, the stopper and the fasteners may together determine the extendable distance of the earphones.

According to an embodiment, the earphone storage structure further comprises a switch formed in the stopper. The switch is switched when the fastener fastens with the stopper.

According to an embodiment, the earphone storage structure further comprises a switch formed in the fastener.

In another embodiment, the present invention provides an earphone storage structure comprising a fastener and a stopper formed in the earphone's wire. The size of the fastener is less than the size of the stopper and the size of the earphone. The stopper and the fastener may together determine the extendable distance of the earphone. In an embodiment, the two earphones are extended from the fastener in the same direction and are located on the same side of the fastener. In another embodiment, the two earphones are extended from the fastener in the opposite direction and are located on different sides of the fastener.

According to an embodiment, the earphone storage structure further comprises a switch formed in the stopper. The switch is switched when the fastener fastens with the stopper.

According to an embodiment, the earphone storage structure further comprises a switch formed in the fastener.

BRIEF DESCRIPTION OF THE DRAWINGS

The foregoing aspects and many of the attendant advantages of this invention will become more readily appreciated and better understood by referencing the following detailed description, when taken in conjunction with the accompanying drawings, wherein.

DETAILED DESCRIPTION OF THE PREFERRED EMBODIMENT

Figure 1A:
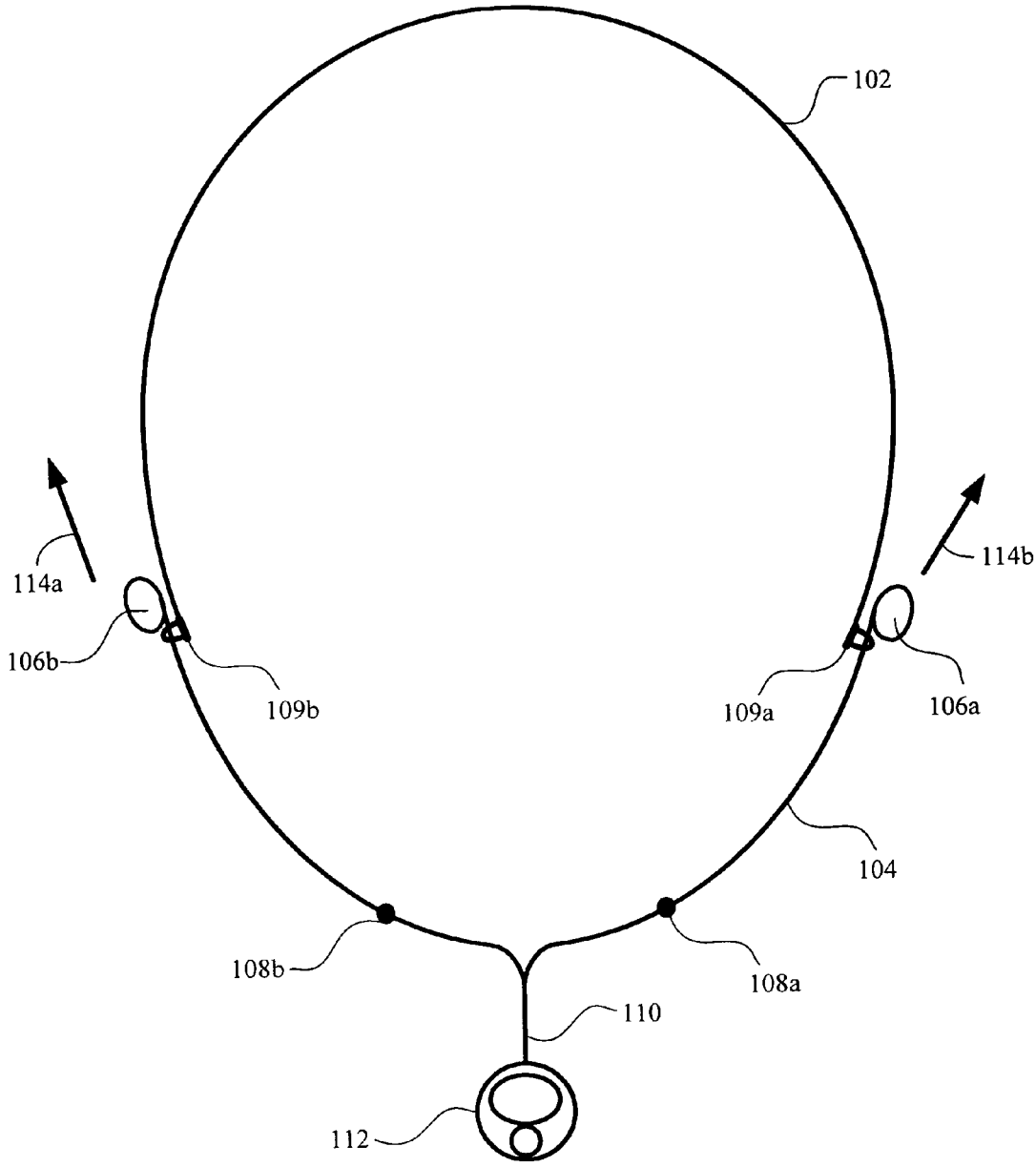
FIG. 1A to FIG. 1E illustrate schematic diagrams of the earphone storage structure according to the first embodiment of the present invention.
Figure 1B:
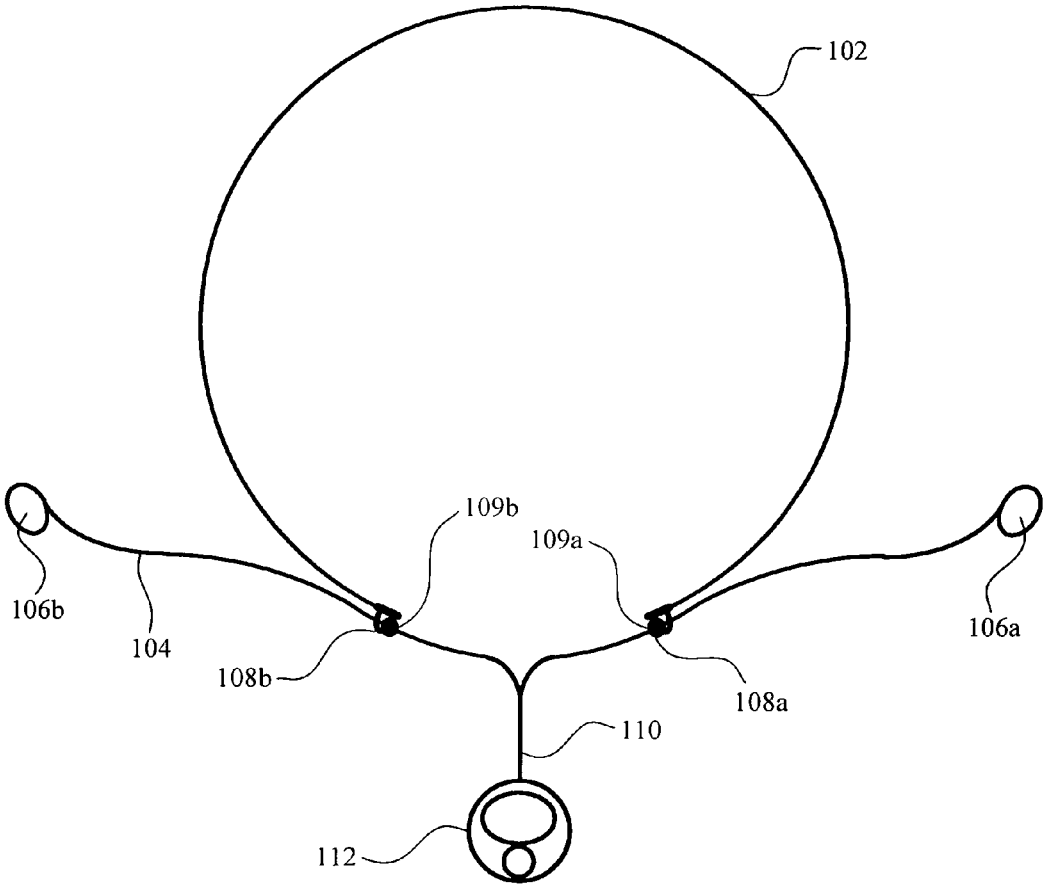

1. FIG. 1A illustrates a schematic diagram of the earphone storage structure according to the first embodiment of the present invention. The earphone storage structure comprises a necklace 102 and earphones 106*a* and 106*b* connected together by a wire 104. Two rings 109*a* and 109*b* are formed in the two ends of the necklace 102 respectively. Two stoppers 108*a* and 108*b* are formed on the wire 104. The size of stoppers 108*a* and 108*b* are large than the size of the rings 109*a* and 109*b*. The wire 104 passes through the two rings 109*a* and 109*b*. The stopper 108*a* and the ring 109*a* together determine the extendable distance of the earphone 106*a*. The stopper 108*b* and the ring 109*b* together determine the extendable distance of the earphone 106*b*. A connector 110 of the wire 104 is formed in the location between the two stoppers 108*a* and 108*b* to connect with a hand-held device 112, such as a cell phone, a PDA or a walkman. In an embodiment, the structure of the stopper 108*a* and 108*b* is similar to a bump.

When a hand-held device 112 is connected to the earphone storage structure, this hand-held device 112 may be hung on the neck of a user with the necklace 102. When the earphones 106*a* and 106*b* are not used, the hand-held device 112 can be hung on the neck as a pendant by the rings 109*a* and 109*b* catching the earphones 106*a* and 106*b* respectively. When using the earphones 106*a* and 106*b*, a user may pull out the earphones 106*a* and 106*b* following the direction indicated by the arrow 114*a* and 114*b* in FIG. 1A. In an embodiment, switches are formed in the stoppers 108*a* and 108*b* respectively. These switches are switched by the touching of the stoppers 108*a* and 108*b* and the rings 109*a* and 109*b*. In another embodiment, a switch is only formed in one of the two stoppers 108*a* or 108*b*. Moreover, in another embodiment, switches are formed in the rings 109*a* and 109*b* respectively. Similarly, in another embodiment, a switch is only formed in one of the two rings 109*a* or 109*b*.

Figure 1C:
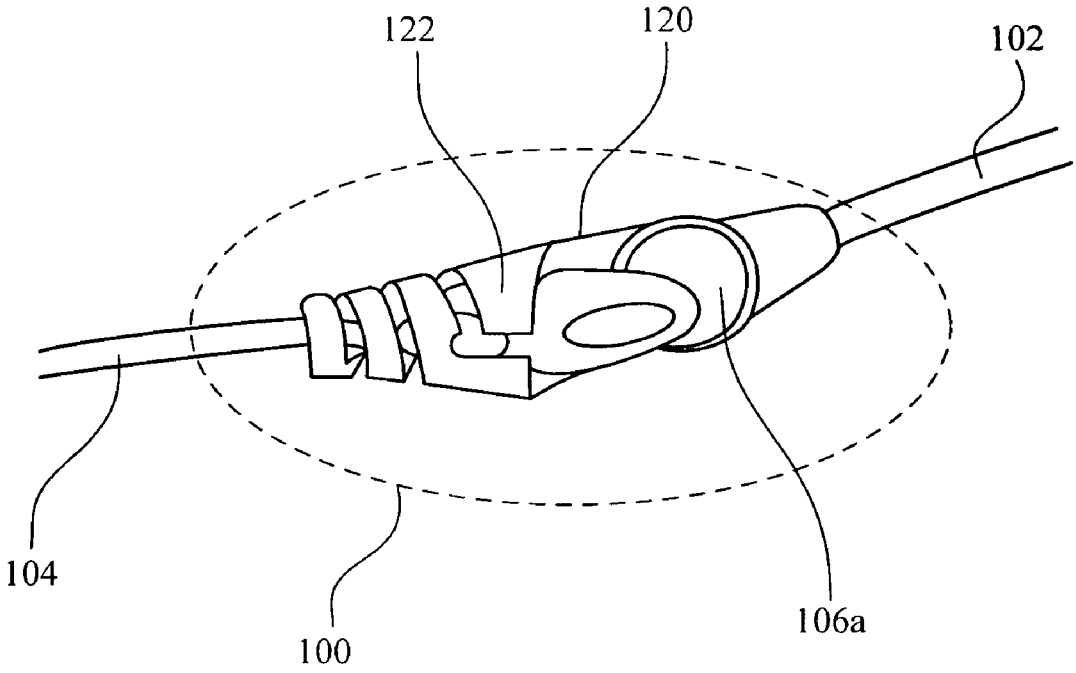

It is noticed that, in these embodiments, the connection of the necklace 102 and the wire 104 passes through the catching rings 109*a* and 109*b* and the earphones 106*a* and 106*b* respectively. However, in another embodiment, as shown in the FIG. 1C, a designed fastener 100 can be used to replace the ring. This fastener 100 includes a base 120 connected with the necklace 102. A ring 122 whose size is less than the size of earphone 106*a* is formed in the base 120. When the earphone 106*a* is not used, this earphone 106*a* may be stored in the base 120 to protect itself. In an embodiment, a special location is set in the base 120 for storing the earphone 106*a* to make the face of the earphone 106*a* always toward the base 120 when the earphone 106*a* is stored in the special location.

Figure 1D:
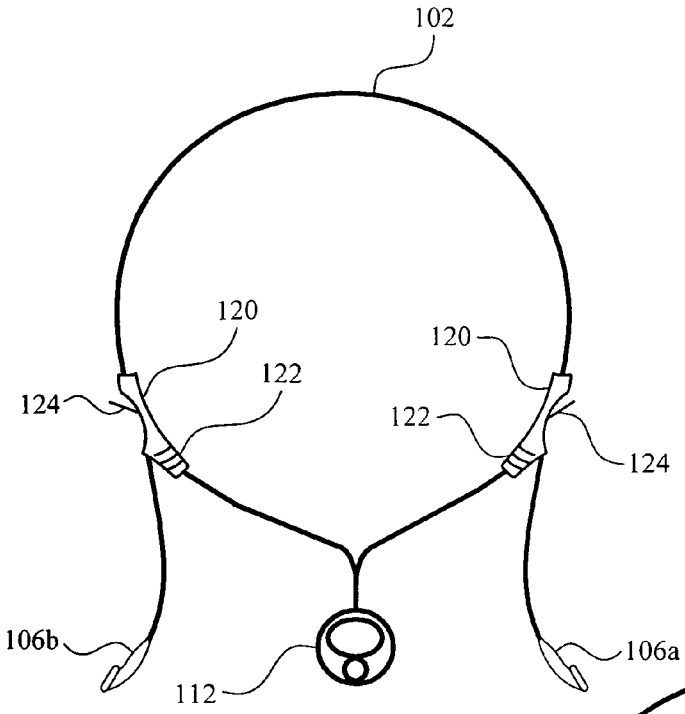
Figure 1E:
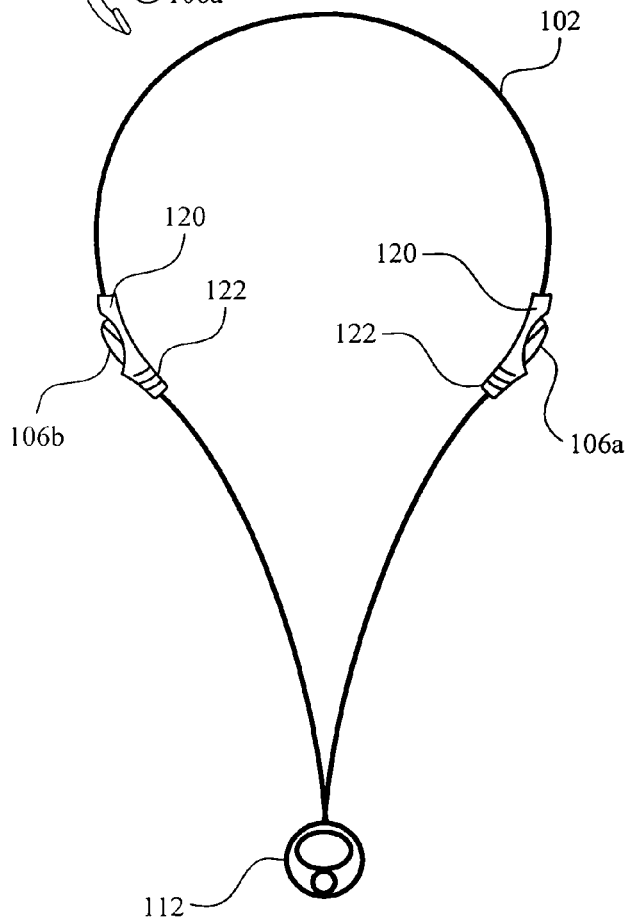

In another embodiment, as shown in the FIG. 1D, a switch 124 is formed in the base 120 to control the hand-held device 112. When the earphone 106*a* or/and earphone 106*b* are used, the switch 124 starts the hand-held device 112 once the earphone leaves the base 120. On the other hand, as shown in the FIG. 1E, when the earphones are located in the base 120, the earphone 106*a* or/and earphone 106*b* touches the switch 124 to stop the hand-held device 112. In another embodiment, if the hand-held device 112 is a cell phone, an additional microphone (not shown in this figure) can be installed on the wire 104. A user can use this microphone to answer a call.

Figure 2A:
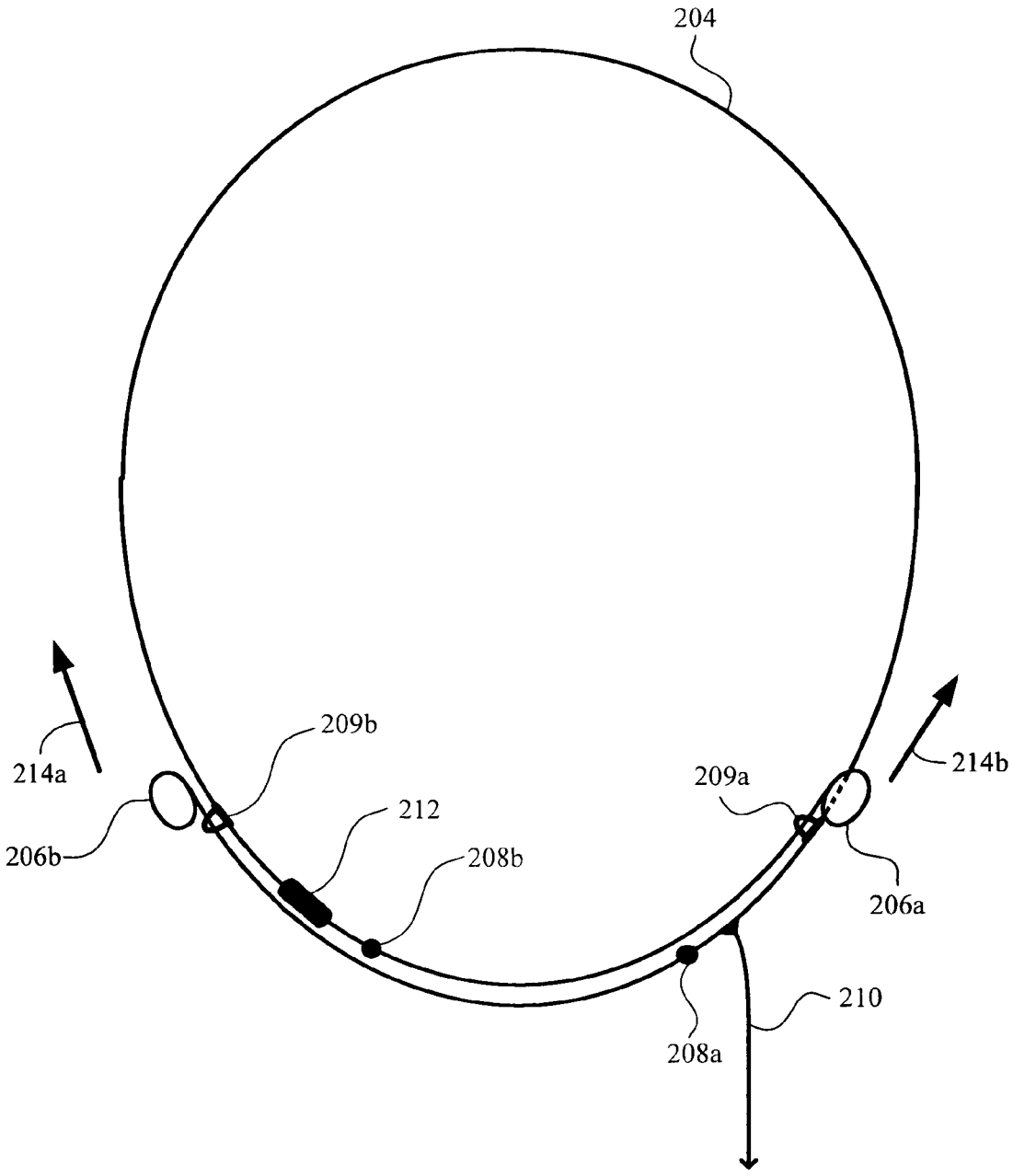
FIG. 2A to FIG. 2C illustrate schematic diagrams of the earphone storage structure according to the second embodiment of the present invention.

FIG. 2A illustrates a schematic diagram of the earphone storage structure according to the second embodiment of the present invention. The earphone storage structure comprises an earphone's wire 204 and two earphones 206*a* and 206*b* connected together by this wire 204. Two rings 209*a* and 209*b* are formed in the two ends of the wire 204 respectively. The size of the rings 209*a* and 209*b* is less than the size of the earphones 206*a* and 206*b*. A stopper 208*a* whose size is larger than the size of the ring 209*b* is formed in the location between the earphone 206*b* and the ring 209*a* in the wire 204. The stopper 208*a* is used to limit the extendable distance of the earphones 206*b*. A stopper 208*b* whose size is larger than the size of the ring 209*a* is formed in the location between the earphone 206*a* and the ring 209*b* in the wire 204. The stopper 208*b* is used to limit the extendable distance of the earphones 206*a*. In an embodiment, the structure of the stopper 208*a* and 208*b* is similar to a bump.

In other words, according to this embodiment, the earphone 206*a*, the stopper 208*b* and the ring 209*b* are sequentially formed in one end of the wire 204. The earphone 206*b*, the stopper 208*a* and the ring 209*a* are sequentially formed in another end of the wire 204. The earphone 206*b* passes through the ring 209*b*. The earphone 206*a* passes through the ring 209*a*. According to this embodiment, the connector 210 is formed in the location between the stopper 208*a* and the ring 209*a*. The microphone 212 is formed in the location between the stopper 208*b* and the ring 209*b*. In another embodiment, the connector 210 and the microphone 212 may also be formed in other locations.

Figure 2B:
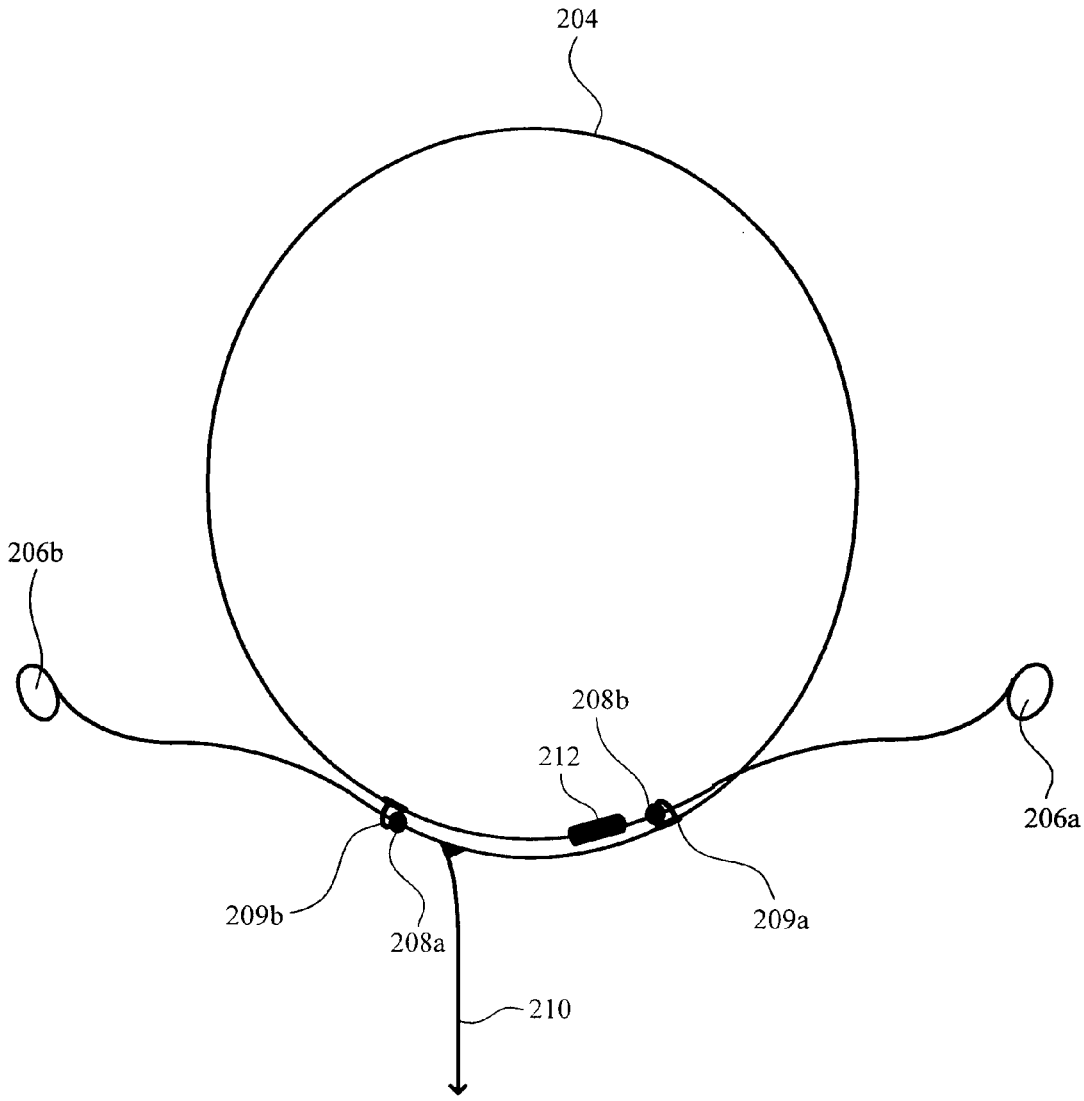
Figure 2C:
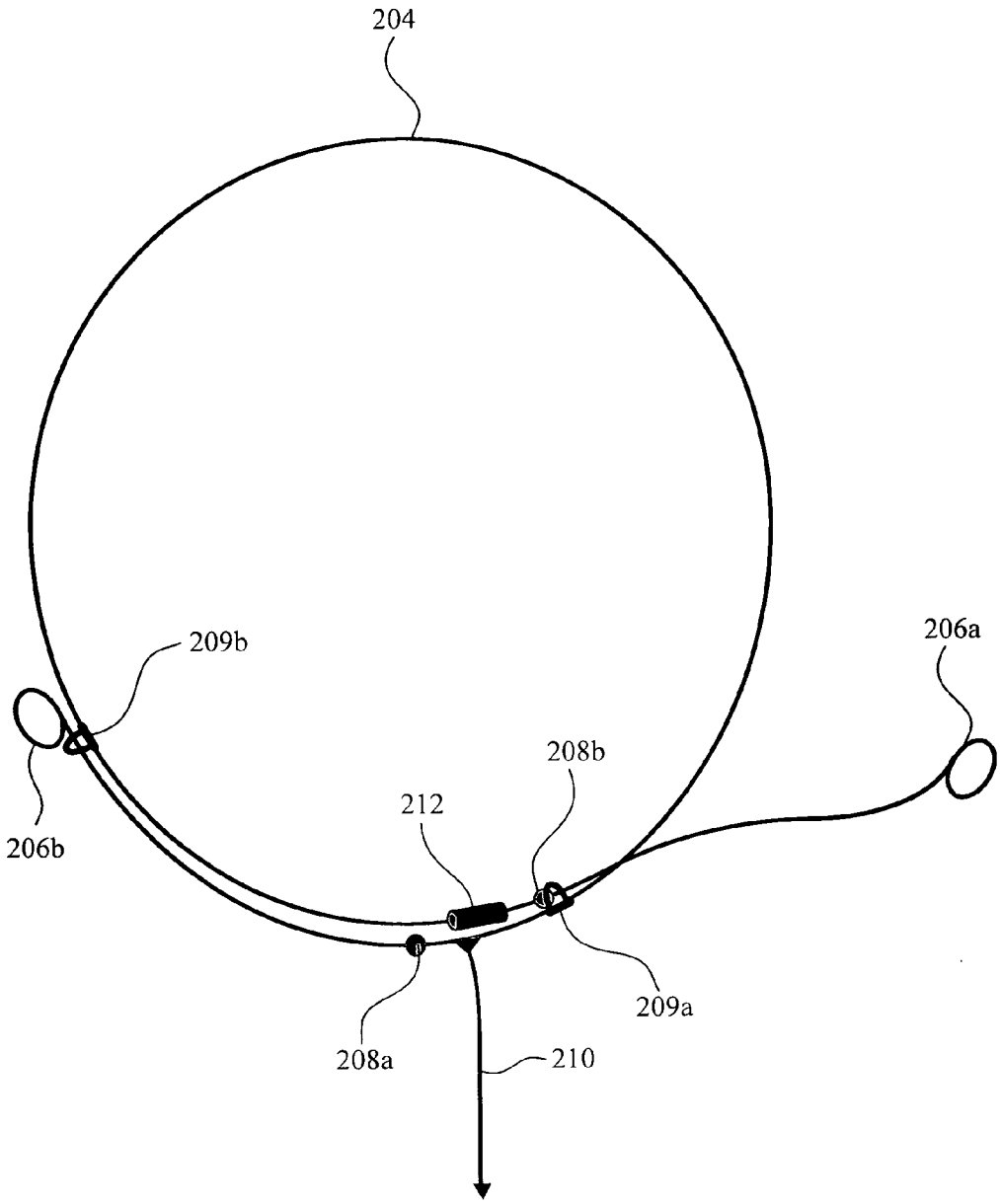

A user may hang the wire 204 on his/her neck to use the earphones. Moreover, as shown in the FIG. 2A, the rings 209*a* and 209*b* may catch the earphones 206*a* and 206*b* respectively. A part of the wire 204 may overlap together in such a structure to reduce the length of the wire 204 and prevent the wire 204 from getting tangled. When using the earphones 206*a* and 206*b*, a user may pull out the earphones 206*a* and 206*b* in the direction indicated by the arrows 214*a* and 214*b* in the FIG. 2B. The stopper 208*b* and the ring 209*a* together determine the extendable distance of the earphone 206*a*. The stopper 208*a* and the ring 209*b* together determine the extendable distance of the earphone 206*b*. On the other hand, as shown in the FIG. 2C, a user may only pull out one of the earphones 206*a* and 206*b*.

It is noticed that the fastener structure 100 described in the first embodiment may also be used in the second embodiment. In an embodiment, switches are formed in the stoppers 208*a* and 208*b* respectively. These switches are switched by touching of the stoppers 208*a* and 208*b* and the rings 209*a* and 209*b*. In another embodiment, a switch is only formed in one of the two stoppers 208*a* and 208*b*. Moreover, in another embodiment, switches are formed in the rings 209*a* and 209*b* respectively. Similarly, in another embodiment switch is only formed in one of the two rings 209*a* and 209*b*.

Figure 3A:
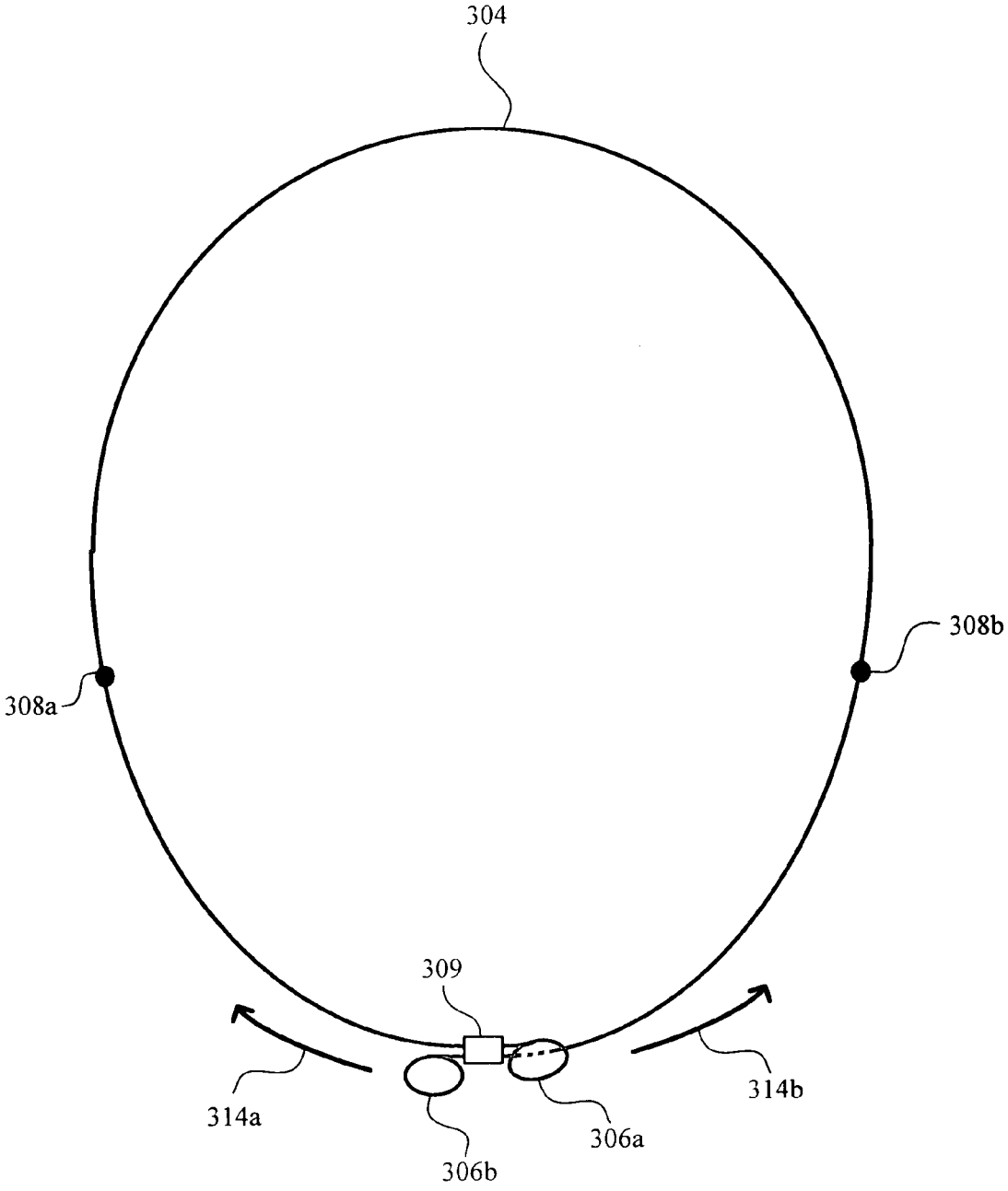
FIG. 3A to FIG. 3B illustrate schematic diagrams of the earphone storage structure according to the third embodiment of the present invention.
Figure 3B:
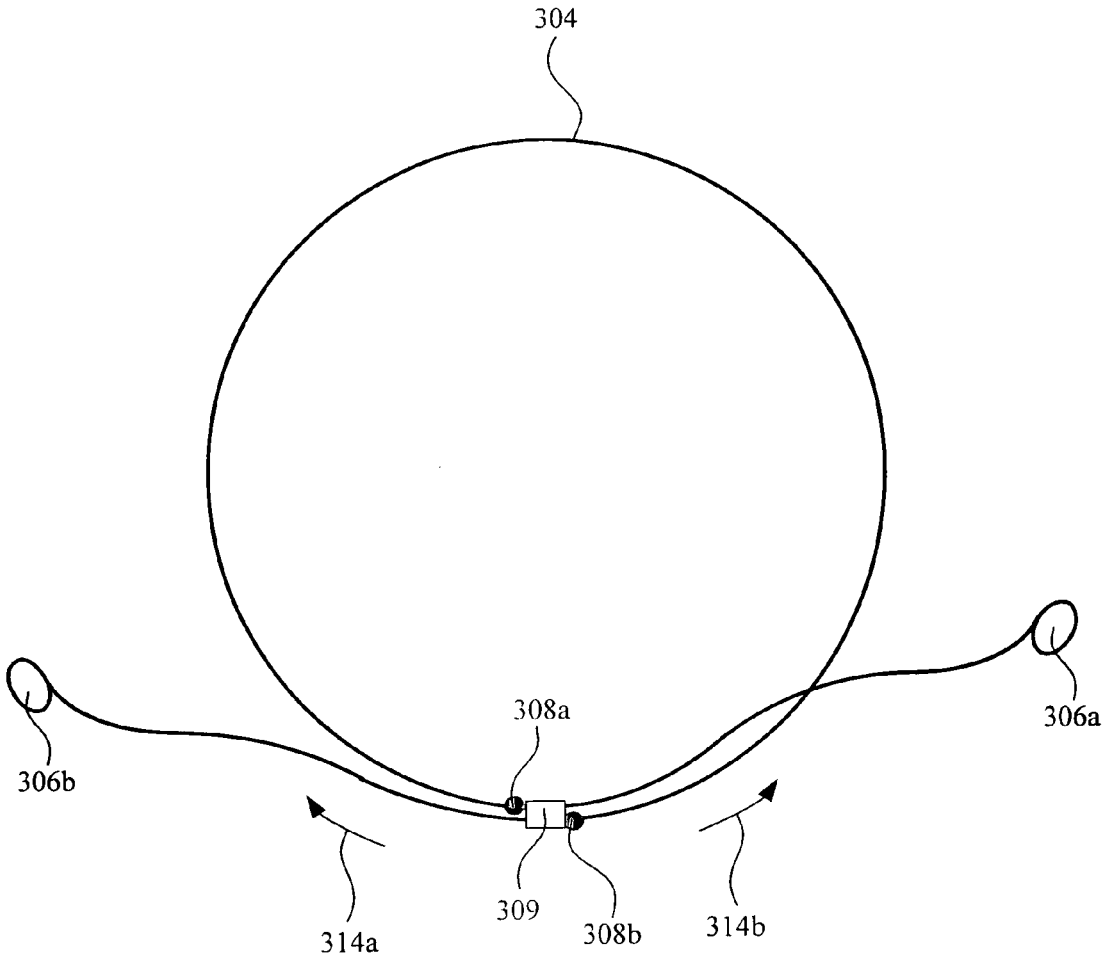

FIG. 3A illustrates a schematic diagram of the earphone storage structure according to the third embodiment of the present invention. The earphone storage structure comprises an earphone's wire 304 and earphones 306*a* and 306*b* connected together by this wire 304. A ring 309 is formed in the wire 304. The size of ring 309 is less than the size of the earphones 306*a* and 306*b*. The earphones 306*a* and 306*b* are located in the two sides of the ring 309 respectively. Therefore, there is an overlap of the wire 304 in the ring 309. A stopper 308*a* whose size is larger than the size of the ring 309 is formed in the location away from the earphone 306*a* in the wire 304. The stopper 308*a* is used to limit the extendable distance of the earphones 306*a*. On the other hand, a stopper 308*b* whose size is larger than the size of the ring 309 is formed in the location away from the earphone 306*b* in the wire 304. The stopper 308*b* is used to limit the extendable distance of the earphones 306*b*. In an embodiment, the structure of the stopper 308*a* and 308*b* is similar to a bump A user may hang the wire 304 on the neck to use the earphones. Moreover, as shown in the FIG. 3A, the ring 309 may catch the earphones 306*a* and 306*b* respectively to prevent the wire 304 from getting tangled. When using the earphones 306*a* and 306*b*, a user may pull out the earphones 306*a* and 306*b* in the direction indicated by the arrows 314*a* and 314*b* in the FIG. 3B. The stopper 308*a* and the ring 309 together determine the extendable distance of the earphone 306*a*. The stopper 308 and the ring 309 together determine the extendable distance of the earphone 306*b*.

It is seen that the fastener 100 structure described in the first embodiment may also be used in the third embodiment. In an embodiment, switches are formed in the stoppers 308*a* and 308*b* respectively. These switches are switched by the touching of the stoppers 308*a* and 308*b* and the ring 309. In another embodiment, the switch is only formed in one of the two stoppers 308*a* or 308*b*. Moreover, in another embodiment, the switch is formed in the ring 309.

Figure 4A:
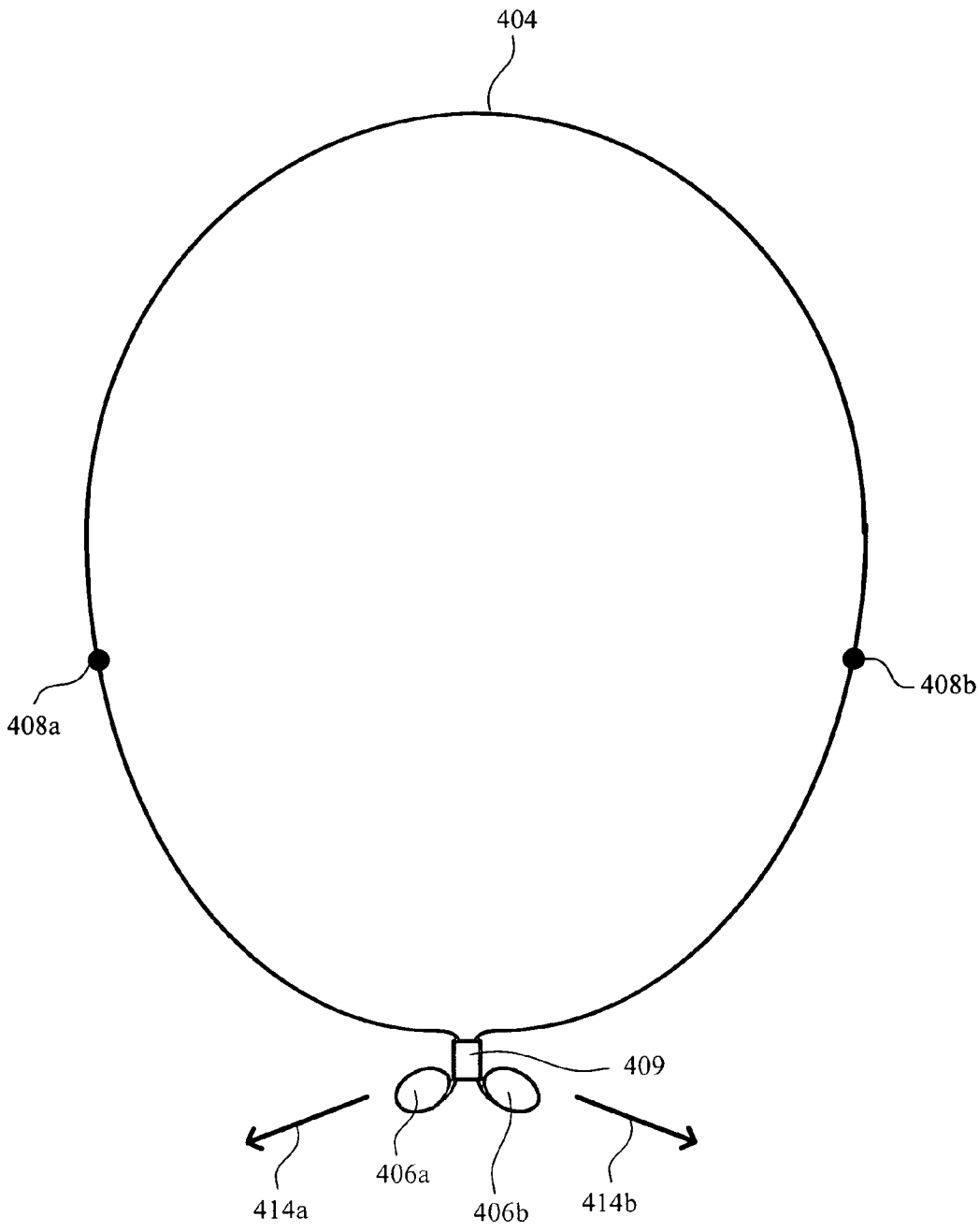
FIG. 4A to FIG. 4B illustrate schematic diagrams of the earphone storage structure according to the fourth embodiment of the present invention.

FIG. 4A illustrates a schematic diagram of the earphone storage structure according to the fourth embodiment of the present invention. The earphone storage structure comprises an earphone's wire 404 and earphones 406*a* and 406*b* connected together by this wire 404. A ring 409 is formed in the wire 404. The size of ring 409 is less than the size of the earphones 406*a* and 406*b*. The main difference between the third embodiment and the fourth embodiment is that the earphones 406*a* and 406*b* are located on the same side of the ring 409. A stopper 408*a* whose size is larger than the size of the ring 409 is formed in a location away from the earphone 406*a* in the wire 404. The stopper 408*a* is used to limit the extendable distance of the earphones 406*a*. On the other hand, a stopper 408*b* whose size is larger than the size of the ring 409 is formed in a location away from the earphone 406*b* in the wire 404. The stopper 408*b* is used to limit the extendable distance of the earphones 406*b*. In an embodiment, the structure of the stopper 408*a* and 408*b* is similar to a bump A user may hang the wire 404 on his/her neck to use the earphones. Moreover, as shown in the FIG. 4A, the ring 409 may catch the earphones 406*a* and 406*b* respectively to avoid the wire 404 from getting tangled. When using the earphones 406*a* and 406*b*, a user may pull out the earphones 406*a* and

Figure 4B:
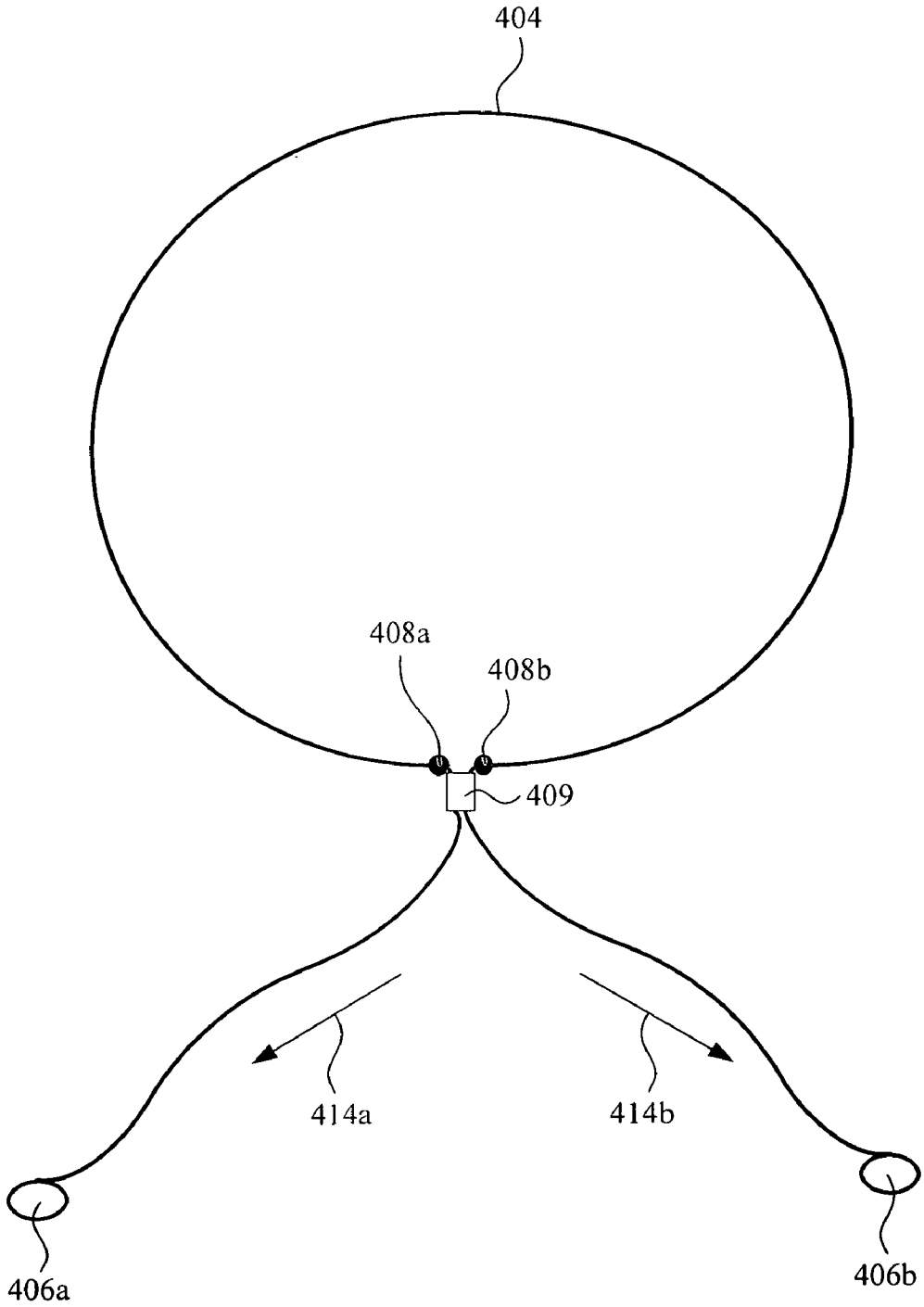

406*b* in the direction indicated by the arrows 414*a* and 414*b* in the FIG. 4B. It is noticed that the fastener structure 100 described in the first embodiment may also be used in the fourth embodiment. In an embodiment, switches are formed in the stoppers 408*a* and 408*b* respectively. These switches are switched by the touching of the stoppers 408*a* and 408*b* and the ring 409. In another embodiment, the switch is only formed in one of the two stoppers 408*a* and 408*b*. Moreover, in another embodiment, switch is formed in the ring 409.

It is noticed that two rings and two stoppers used in the foregoing embodiments limit the extendable distances of the earphones. However, in another embodiment, based on actual user habits, one ring and one stopper design may also be used in the store structure.

Accordingly, the earphone storage structure comprises a stopper and a fastener. The earphone and the stopper are located on different sides of the fastener. The fastener and the stopper may together determine the extendable distance of the earphone to avoid the earphone's wire wound together.

As is understood by a person skilled in the art, the foregoing descriptions of the preferred embodiments of the present invention are an illustration of the present invention rather than a limitation thereof. Various modifications and similar arrangements are included within the spirit and scope of the appended claims. The scope of the claims should be accorded to the broadest interpretation so as to encompass all such modifications and similar structures. While preferred embodiments of the invention have been illustrated and described, it will be appreciated that various changes can be made therein without departing from the spirit and scope of the invention.

What is claimed is:

1. An earphone storage structure characterized in that it comprises:

one wire used as a necklace;

one hollow fastener integral to one end of said wire, the other end of said wire passing through said fastener;

one earphone fixed to said other end of said wire, placing said earphone on one side of said fastener;

one stopper integral to said wire and placed on the other side of said fastener so that:

said stopper bumps against said fastener for stopping the path of the part of said wire connected to said earphone when said earphone is pulled away from said fastener; and said fastener fastens said earphone when the part of the wire corresponding to said other side of said fastener is pulled away from said fastener.

2. The earphone storage structure of claim 1, further comprising a connector formed in said wire to connect with a hand-held device.

3. The earphone storage structure of claim 2, wherein said hand-held device is a cell phone, a media player, or a PDA.

4. The earphone storage structure of claim 1, further comprising a microphone formed in said wire.

5. The earphone storage structure of claim 1, wherein said fastener is a ring and the diameter of said ring is less than the diameter of said earphone and the diameter of said stopper.

6. The earphone storage structure of claim 1, further comprising at least one switch located in said fastener or in said stopper.

* * * * *